US005890337A

United States Patent [19]

Boeshart

[11] Patent Number: 5,890,337

[45] Date of Patent: Apr. 6, 1999

[54] DOUBLE TIE

[76] Inventor: Patrick E. Boeshart, P.O. Box 774, Sioux City, Iowa 51102

[21] Appl. No.: 949,967

[22] Filed: Oct. 14, 1997

[51] Int. Cl.[6] ..... E04B 2/84; E04G 11/06

[52] U.S. Cl. ..... 52/426; 52/432; 52/442; 52/562; 249/38; 249/41; 249/191; 249/214; 249/216

[58] Field of Search ..... 52/426, 432, 442, 52/562, 565; 249/38, 40, 41, 44, 191, 192, 213, 214, 216

[56] References Cited

U.S. PATENT DOCUMENTS

D. 378,049 2/1997 Boeshart .
4,730,422 3/1988 Young .
4,765,109 8/1988 Boeshart .
4,884,382 12/1989 Horobin .
4,889,310 12/1989 Boeshart .
5,039,058 8/1991 Boeshart .

*Primary Examiner*—Carl D. Friedman
*Assistant Examiner*—Kevin D. Wilkens
*Attorney, Agent, or Firm*—Koley, Jessen, Daubman & Rupiper, P.C.; Mark D. Frederiksen

[57] ABSTRACT

A double tie includes a pair of upper and lower straps connected in parallel relationship by a pair of vertical plates attached to the outward ends of the straps. The plates are oriented orthogonally relative to the straps to form a general "T" shape. A pair of stop straps are mounted on the plates intermediate the upper and lower straps, and projecting towards one another. The stop straps have orthogonal heads spaced inwardly from the plates a distance to retain a form panel between the head and plate. Each upper and lower strap has a hinge formed at each end, the hinges at each end of the upper and lower straps being coaxial and parallel to the plates, such that the upper and lower straps may be pivoted from a position generally orthogonal to the plates, to a position generally parallel to the plates.

9 Claims, 5 Drawing Sheets

DOUBLE TIE

TECHNICAL FIELD

The present invention relates generally to ties for concrete wall systems, and more particularly to an improved tie for interconnecting vertical pairs of form panels and opposing horizontally spaced pairs of parallel form panels.

BACKGROUND OF THE INVENTION

The use of expanded polystyrene panels as forms for poured concrete walls has become quite common in the industry. After the concrete has hardened between the form panels, the panels may be left in place on the walls to serve as permanent insulation, where they may be stripped off of the concrete walls to reveal the exposed concrete.

As new developments occur in this industry, larger and longer panels are being utilized to create the concrete forms of the forming system. In addition, methods have been continuously developed for increasing the speed of constructing the forms, and reducing the overall cost of the form system.

One particular feature of current form systems calls for the placement of connecting ties at uniformly spaced apart locations along the length of the upper and lower edges of each form panel. This can be quite time consuming, and thereby contributes to the cost of use of this type of form system.

Transportation of preassembled units is typically not economical because of the great amount of space required when the ties hold the form panels spaced apart from one another.

SUMMARY OF THE INVENTION

It is therefore a general object of the present invention to provide an improved tie for use with polystyrene panel-type forms in poured concrete wall forming systems.

Another object is to provide a concrete wall form tie which will rigidly hold the form panels necessary to construct a poured concrete wall.

A further object of the present invention is to provide a double tie which may be attached to the adjoining lower and upper edges of a pair of vertically aligned form panels to interconnect the panels together, while interconnecting these form panels with an opposing horizontally spaced pair of form panels.

Yet another object is to provide a tie which may be folded, to permit an assembled unit to be pivoted to an orientation with the form panels immediately adjacent one another, thereby conserving space.

These and other objects of the present invention will be apparent to those skilled in the art.

The double tie of the present invention includes a pair of upper and lower straps connected in parallel relationship by a pair of vertical plates attached to the outward ends of the straps. The plates are oriented orthogonally relative to the straps to form a general "T" shape. A pair of stop straps are mounted on the plates intermediate the upper and lower straps, and projecting towards one another. The stop straps have orthogonal heads spaced inwardly from the plates a distance to retain a form panel between the head and plate. Each upper and lower strap has a hinge formed at each end, the hinges at each end of the upper and lower straps being coaxial and parallel to the plates, such that the upper and lower straps may be pivoted from a position generally orthogonal to the plates, to a position generally parallel to the plates.

DESCRIPTION OF THE PREFERRED EMBODIMENT

Figure 1:
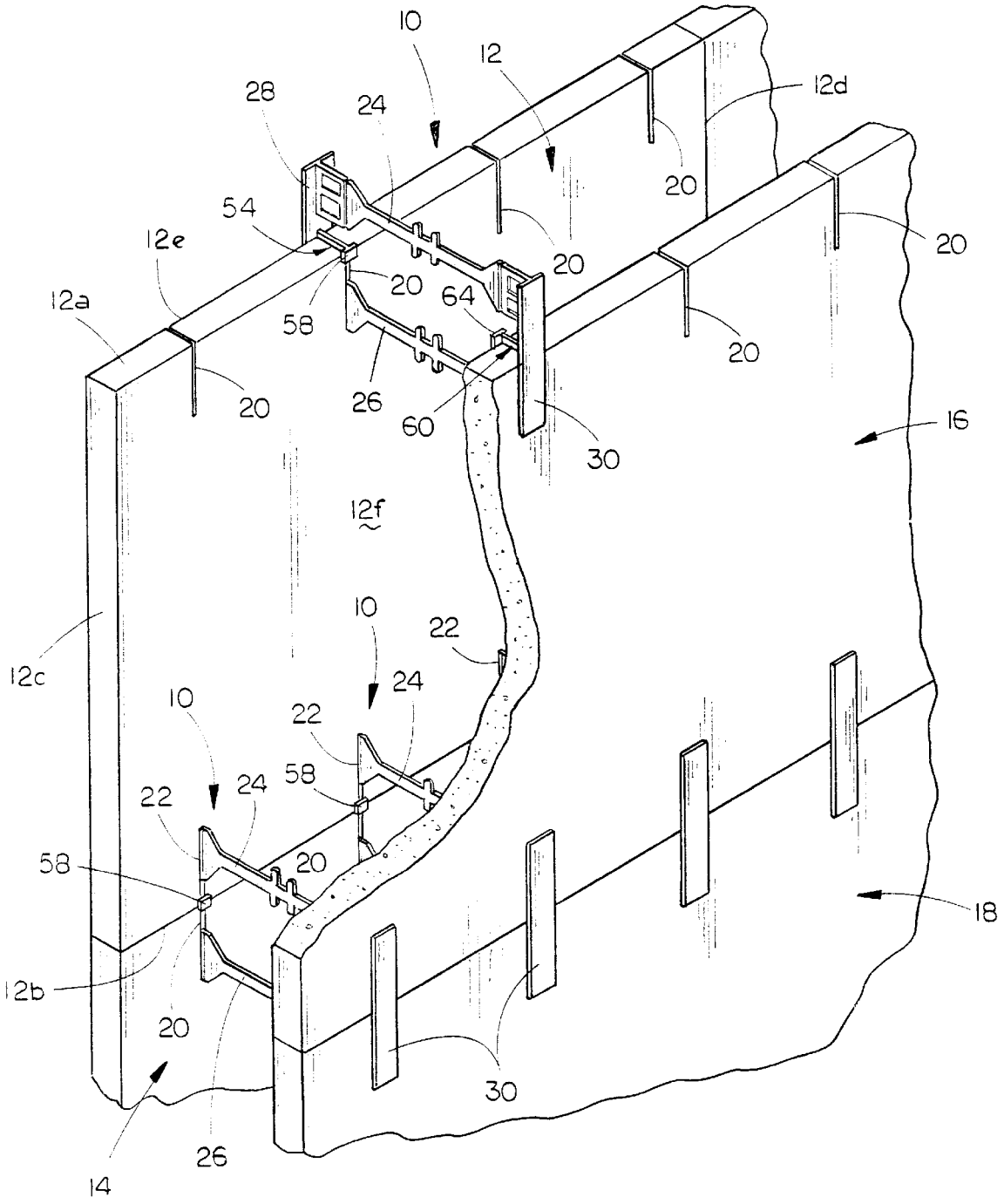
FIG. 1 is a perspective view of a series of form panels connected together with a plurality of the double ties of the present invention, ready to receive concrete.

Referring now to the drawings, in which similar or corresponding parts are identified with the same reference numeral and more particularly to FIG. 1, the tie of the present invention is designated generally at 10, and a plurality of ties 10 are shown interconnecting a plurality of form panels 12, 14, 16, and 18.

Form panels 12, 14, 16, and 18 are identical, and therefore only panel 12 will be described in detail. Form panel 12 includes an upper edge 12*a*, a lower edge 12*b*, a side edge 12*c*, and an opposing side edge 12*d*. Panel 12 also includes an outward face 12*e* and an inward face 12*f*. A plurality of tie slots 20 are cut into the upper edge 12*a* of panel 12, and extend downwardly to receive a lower half of tie 10 therein. Upper tie slots 20 are uniformly spaced apart along the upper edge of panel 12. A plurality of lower tie slots 22 are formed along the lower edge of panel 12, vertically aligned with upper tie slots 20, to receive an upper half of ties 10 therein. Panels 14, 16, and 18 include similar upper and lower tie slots which will align with the tie slots in the horizontally opposing panel, as well as vertically adjacent panels to receive ties 10.

Figure 2:
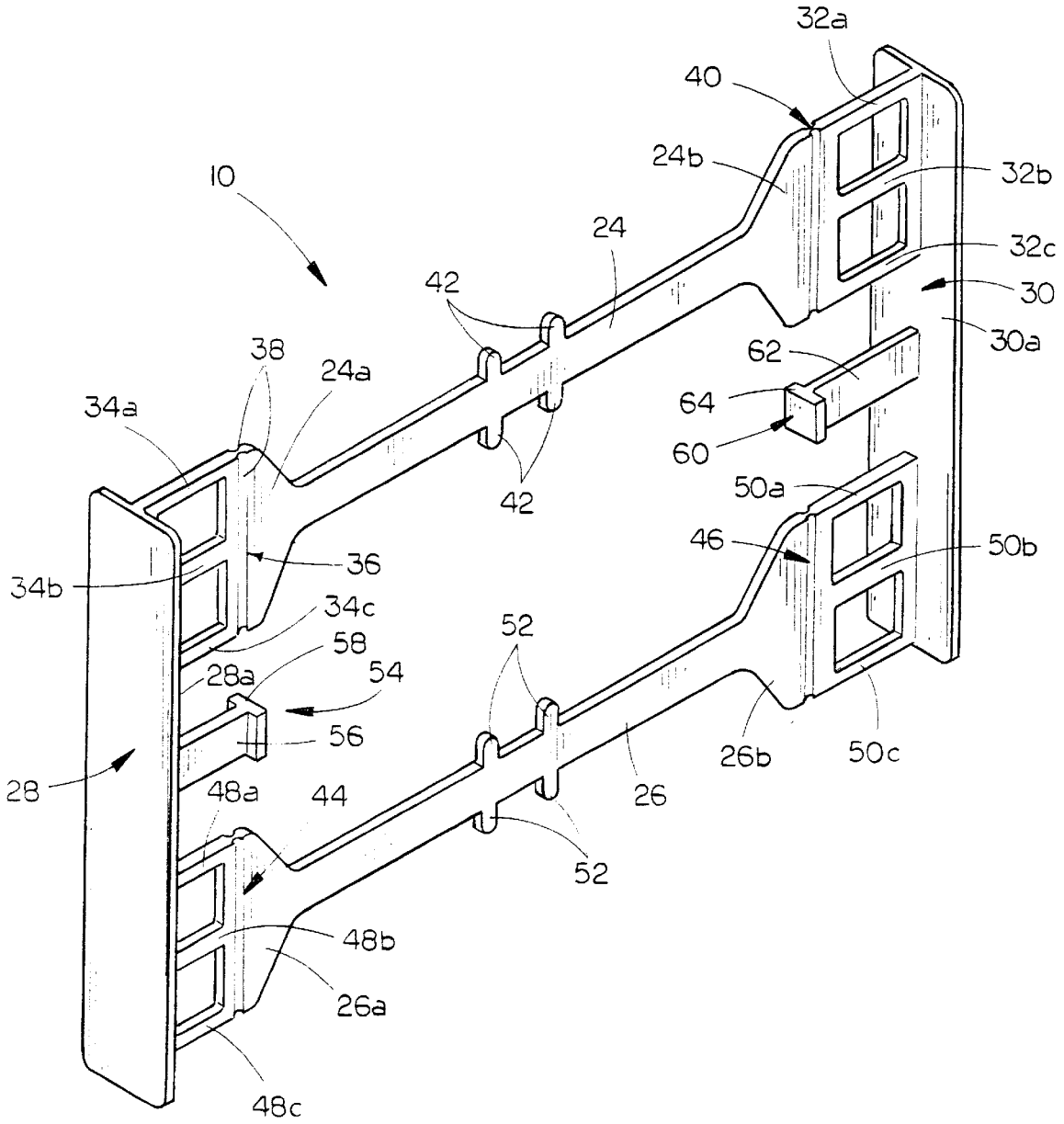
FIG. 2 is an enlarged perspective view of the double tie of the present invention.

Referring now to FIG. 2, double tie 10 includes a pair of upper and lower elongated connector straps 24 and 26, oriented parallel to one another and connected at their opposing ends to opposing vertical plates 28 and 30. The opposing ends 24*a* and 24*b* of strap 24 are enlarged in the vertical dimension, to provide greater structural strength. Three parallel horizontal legs 32*a*, 32*b*, and 32*c* project outwardly from the end 24*b* of strap 24, and are vertically spaced apart. Legs 32*a, b*, and *c* are rigidly connected to plate 30 to form a general "T" shape in horizontal cross-section. While the spaces between legs 32*a* and 32*b*, and between legs 32*b* and 32*c* are shown as openings in the drawings, it should be understood that these openings could be filled with material to form a solid panel connecting strap 24 to plate 30. Openings, or a thin sheet of material is preferred, such that legs 32*a*, 32*b*, and 32*c* are formed. The use of small cross-sectional legs 32*a, b*, and *c* permits plate 30 to be more easily removed from the end of strap 24 by breaking the legs 32*a, b*, and *c*.

The opposing end 24*a* of upper strap 24 also has a plurality of legs 34*a*, 34*b*, and 34*c* similar to legs 32*a, b*, and *c*, but projecting in the opposite direction. Legs 34*a, b*, and *c* connect end 24*a* with plate 28, as shown in the drawings.

A living hinge 36 is formed in strap end 24*a* by a pair of diametric, vertically oriented grooves 38. Hinge 36 permits pivotal movement of strap 24 about hinge 36, along a pivot axis parallel to plate 28. Hinge 36 is spaced away from plate 28 a distance slightly greater than the thickness of the form panel upon which tie 10 will be used, such that strap 24 is pivotable once tie 10 is attached to the form panel.

A similar hinge 40 is formed in the opposing end 24*b* of strap 24 spaced away from plate 30 a distance equal to the distance which hinge 36 is spaced from plate 28. Hinges 36 and 40 have parallel pivotal axes, which in turn are parallel with plates 28 and 30.

A pair of spaced apart pegs 42 project upwardly and downwardly from strap 24, and are generally centered between strap ends 24*a* and 24*b*. Pegs 42 are used to position and align reinforcement bar between form panels.

Strap 26 is identical to strap 24, and includes all of the same components described above, which therefore will not be described in detail. Thus, strap 26 includes enlarged ends 26*a* and 26*b*, hinges 44 and 46, and a plurality of legs 48*a*, 48*b*, and 48*c*, and 50*a*, 50*b*, and 50*c*. Hinge 44 is vertically aligned with hinge 36 on upper strap 24, and lower strap hinge 46 is similarly vertically aligned with upper strap hinge 40. Lower strap 26 also includes pairs of pegs 52 projecting upwardly and downwardly from strap 26 and aligned with pegs 42 on upper strap 24.

A T-shaped stop strap 54 is mounted on the inward face 28*a* of plate 28, and projects inwardly therefrom, parallel to upper and lower straps 24 and 26, and centered therebetween. Stop strap 54 includes a stem 56 projecting from plate 28, and a head 58 extending orthogonally relative to stem 56 to form the "T" shape. Head 58 is located in general alignment with upper stem hinge 36 and lower stem hinge 44, and serves to prevent form panels from being pushed inwardly away from plate 28. A similar stop strap 60 is positioned opposite stop strap 54, on the inward face 30*a* of plate 30, between upper and lower straps 24 and 26. Stop strap 60 also includes a stem 62 and a head 64, the same as stop strap 54.

Referring once again to FIG. 1, it can be seen that each tie 10 is used by inserting the ends of the lower strap 26 in to the upper tie slots 20 on pairs of opposing panels 12 and 16, and opposing panels 14 and 18. The depth of slots 20 is predetermined, such that tie 10 will contact the bottom of upper slots 20 when the upper edges of the form panels are positioned half way up on stop straps 54 and 60. In this way, the stop strap heads 58 and 64 will have a lower portion retaining a pair of lower opposing panels from inward movement, and an upper portion retaining the lower edge of a pair of upper form panels from moving inwardly.

Once a plurality of ties 10 have been inserted in the upper slots 20 on a pair of opposing form panels, an additional pair of form panels are connected in vertical alignment with the lower pair of form panels, by inserting the lower tie slots 22 of each form panel on the opposing ends of the upper straps 24 of ties 10. Once positioned between the form panels, outer plates 28 and 30 will be located adjacent the outward faces of the panels to prevent outward movement of the form panels, and the stop strap heads 58 and 64 will be located adjacent the inward faces of the form panels to prevent inward movement of the form panels into the space which will receive concrete. It can therefore be seen that each tie 10 will interconnect two pairs of horizontally opposed form panels in vertical alignment, to permit the formation of a concrete wall therebetween.

Figure 3:
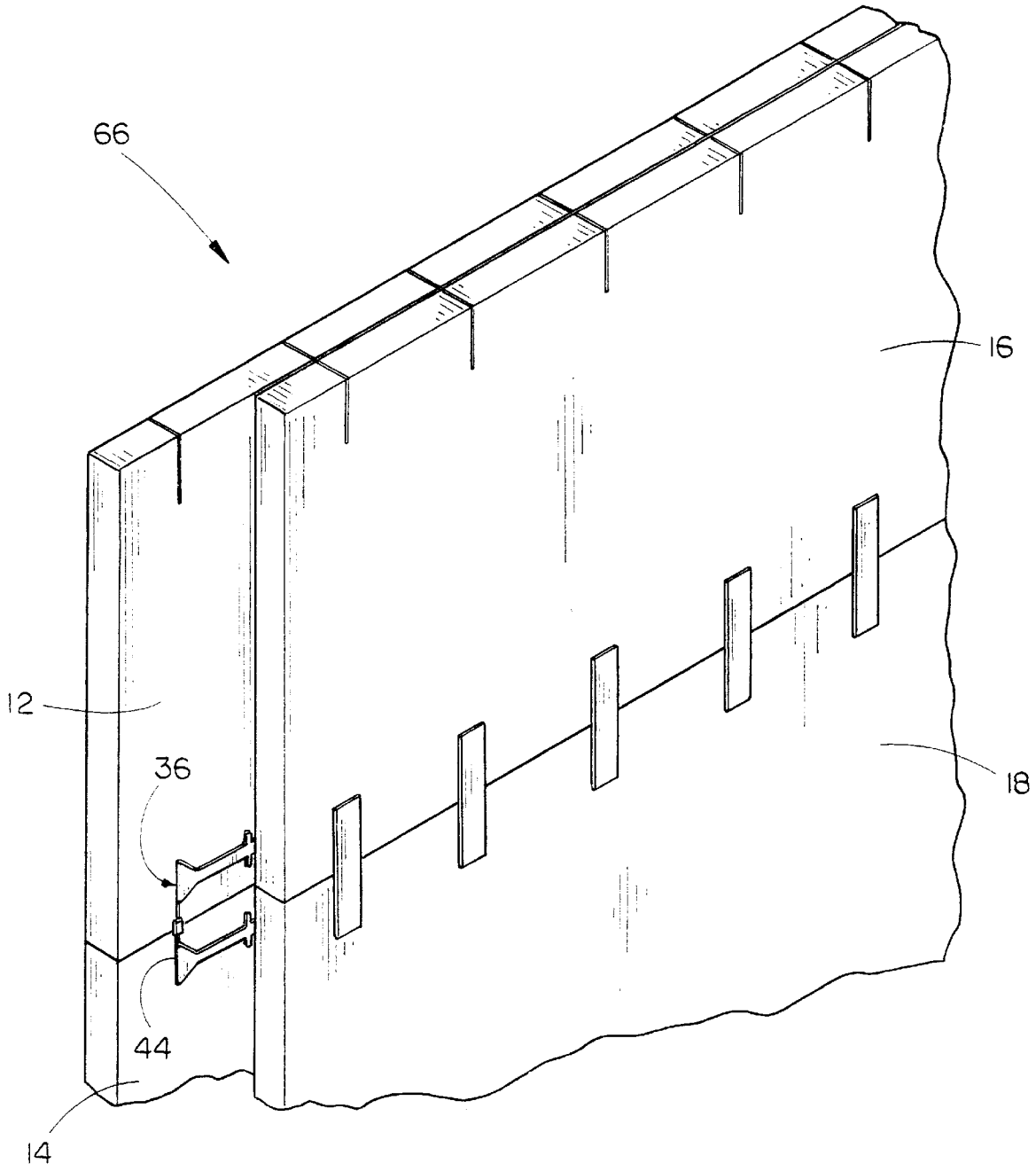
FIG. 3 is a view similar to FIG. 1, but with the tie pivoted to a transport position.
Figure 4:
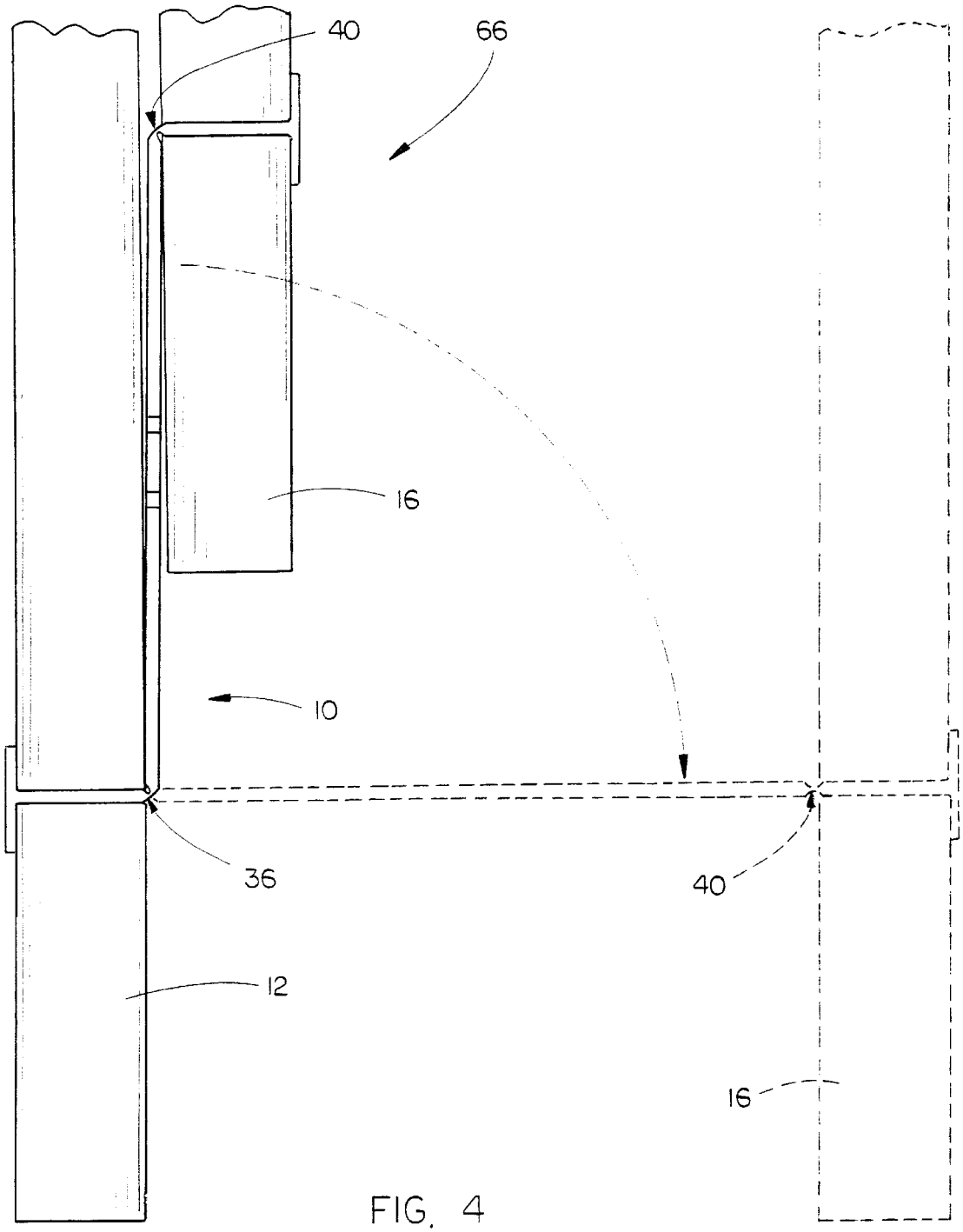
FIG. 4 is an enlarged top elevational view of FIG. 3, with a second position of the tie shown in broken lines.

Referring now to FIGS. 3 and 4, each tie 10 is designed to permit pivotal movement about two vertical axes formed by pairs of hinges 36 and 44, and 40 and 46. This pivoting or folding capability permits the form panels 12, 14, 16, and 18 to be assembled into a form unit, designated generally at 66 in FIG. 3, and then moved to a compact orientation with the upper form panels 12 and 16 proximal one another and the lower form panels 14 and 18 proximal one another. As shown in FIG. 4, this dramatically reduces the space requirement for transport of an assembled unit 66, and thereby increases the economic feasibility of shipping the form units 66 in an assembled condition, rather than as a set of unconnected components. Shipment as an assembled unit dramatically decreases the set up time at the job site, thereby decreasing the cost of use of the system.

Figure 5:
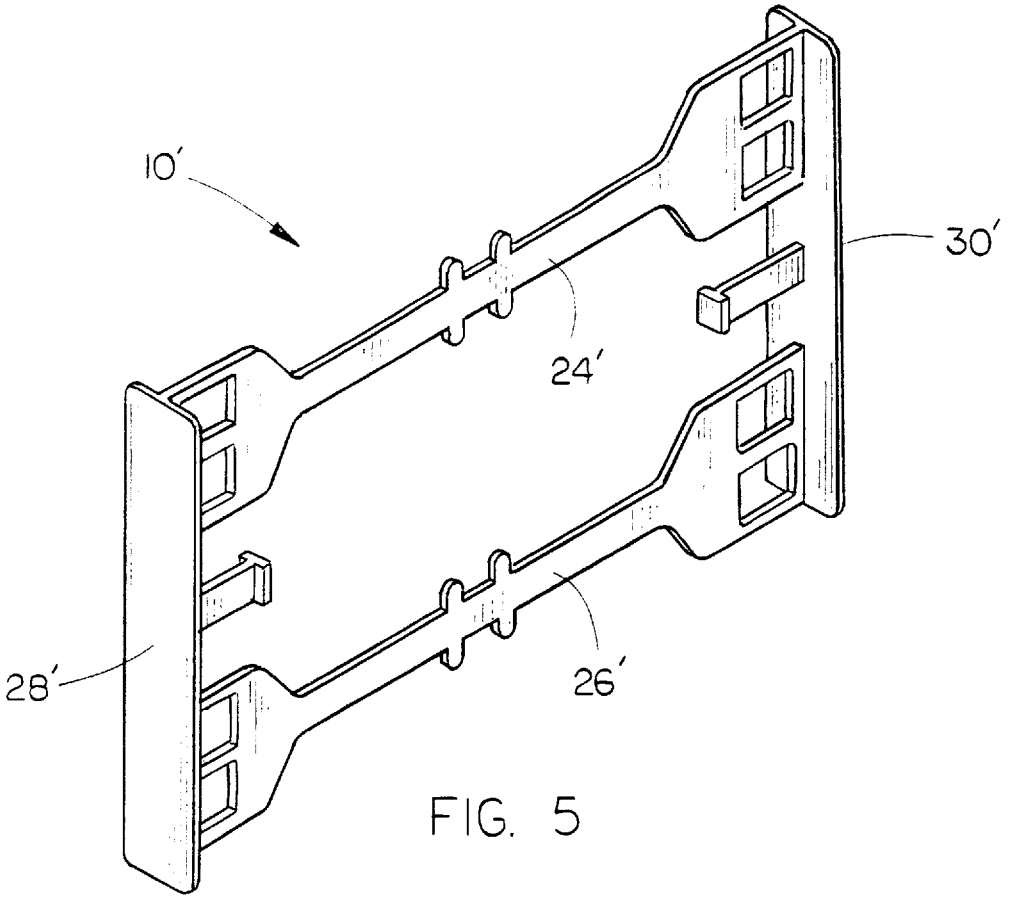
FIG. 5 is a perspective view of a second embodiment of the tie.
Figure 6:
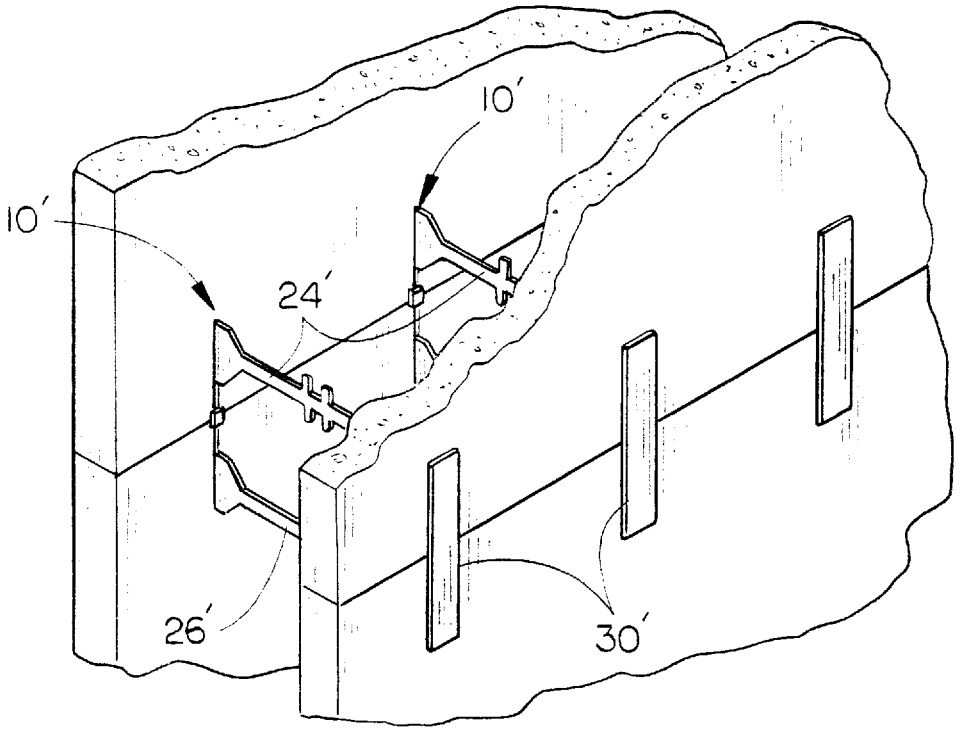
FIG. 6 is a perspective view of the second embodiment of the tie installed on form panels.

Referring now to FIGS. 5 and 6, a second embodiment of the tie is designated generally at 10' and is identical to the first embodiment of the tie 10, except that hinges 36, 40, 44, and 46 are not formed into the tie. Thus, upper and lower straps 24' and 26' remain in an orthogonal orientation connected to plates 28' and 30', whereas the straps 24 and 26 of tie 10 may be moved to a generally parallel orientation relative to plates 28 and 30, during transport.

Whereas the invention has been shown and described in connection with the preferred embodiment thereof, many modifications, substitutions and additions may be made which are within the intended broad scope of the appended claims.

I claim:

1. In combination:

a first pair of parallel, horizontally spaced apart form panels, having upper and lower edges and inward and outward faces;

a second pair of parallel, horizontally spaced apart form panels, vertically aligned with the first pair of form panels, having upper and lower edges and inward and outward faces;

a plurality of upper tie slots formed downwardly into the upper edges of each of the first and second pairs of form panels;

a plurality of lower tie slots formed upwardly into the lower edges of each of the first and second pairs of form panels;

said first pair of form panels located atop the second pair of form panels with the lower slots in the first pair of form panels aligned vertically with the upper slots in the second pair of form panels; and a plurality of ties connecting the panels of each of the first and second pairs of form panels together, and connecting the first pair of panels in vertical alignment with the second pair of panels;

each said tie including:

an upper tie strap extending between and inserted through a lower tie slot in each of said first pair of form panels;

a lower tie strap extending between and inserted through an upper tie slot in each of said second pair of form panels;

a first plate connecting first ends of the upper and lower tie straps; and a second plate connecting second ends of the upper and lower tie straps;

said first and second plates being positioned against the outward faces of the panels to prevent outward movement of the panels off of the upper and lower straps, and further comprising:

first and second stop straps mounted on the first and second plates and projecting towards one another;

said stop straps having coaxial elongated stems and a head at a free inward end of the stems; and said heads oriented orthogonally relative to the stems and parallel to one another, and positioned against the inward faces of the panels to prevent inward movement of the panels along the upper and lower straps.

2. The combination of claim 1, wherein each strap includes a hinge located inward and proximal the inward faces of the panels, the hinges on the upper strap having axes coaxial with axes of the hinges on the lower strap.

3. A tie for retaining two pairs of parallel, horizontally opposed, form panels in vertical alignment, comprising;

upper and lower horizontal and parallel elongated straps connected together at opposing first and second ends by first and second elongated vertically oriented plates;

said plates being oriented orthogonally relative to the straps to form a "T" shape connection at each end of said straps; and first and second stop straps mounted on the first and second plates and projecting towards one another, said stop straps having coaxial, elongated stems, and a head at a free inward end of the stems, the heads oriented orthogonally relative to the stems and parallel to one another.

4. The tie of claim 3, wherein said first and second stop straps have stems of equal length.

5. The tie of claim 4, wherein the ends of said upper and lower straps are enlarged in a vertical direction and coplanar.

6. The tie of claim 5, wherein each strap end is connected to said plates by at least two spaced apart coplanar legs.

7. The tie of claim 6, wherein each strap end includes a vertically oriented hinge spaced away and parallel to said plates, said hinges permitting pivotal movement of the straps from positions generally orthogonal to the plates to positions generally parallel to the plates.

8. The tie of claim 7, wherein the hinges on the upper strap ends have axes coaxial with axes of the hinges on the lower strap ends.

9. The tie of claim 8, wherein said hinge axes are spaced from the plate proximal thereto a distance substantially the same as the length of the stop strap stem proximal to the hinge axes.

* * * * *